US011390515B2

(12) United States Patent
Lynch et al.

(10) Patent No.: US 11,390,515 B2
(45) Date of Patent: Jul. 19, 2022

(54) WALL MOUNTED BEVERAGE DISPENSING SYSTEM

(71) Applicant: Elkay Manufacturing Company, Oak Brook, IL (US)

(72) Inventors: Erik Victor Lynch, Downers Grove, IL (US); John F. Conway, II, Chicago, IL (US); Colin Peter Kelly, Hanover, IL (US)

(73) Assignee: Elkay Manufacturing Company, Oak Brook, IL (US)

( * ) Notice: Subject to any disclaimer, the term of this patent is extended or adjusted under 35 U.S.C. 154(b) by 0 days.

(21) Appl. No.: 17/248,793

(22) Filed: Feb. 8, 2021

(65) Prior Publication Data

US 2021/0179417 A1 Jun. 17, 2021

Related U.S. Application Data

(63) Continuation of application No. 16/299,730, filed on Mar. 12, 2019, now Pat. No. 10,926,993.

(51) Int. Cl.
*B67D 3/00* (2006.01)
*B67D 1/12* (2006.01)

(52) U.S. Cl.
CPC ..... *B67D 3/0077* (2013.01); *B67D 1/1211* (2013.01)

(58) Field of Classification Search
CPC ..... B67C 3/2637; B67C 3/28; E03C 1/02; B67D 3/0083; B67D 3/009; B67D 3/0041; B67D 3/0003; B67D 3/0077; B67D 1/00894; B67D 1/1234; B67D 1/1247; B67D 1/0891; B67D 1/16; B67D 1/1211
USPC ..... 222/1
See application file for complete search history.

(56) References Cited

U.S. PATENT DOCUMENTS

| | | | | |
|---|---|---|---|---|
| 8,109,301 | B1 * | 2/2012 | Denise | F25D 23/126 222/113 |
| 8,250,880 | B2 * | 8/2012 | Moon | F25D 23/126 62/448 |
| 8,353,321 | B2 * | 1/2013 | Agam | B67D 1/124 141/94 |
| 8,746,296 | B2 * | 6/2014 | Tobbe | F25D 23/126 141/351 |
| 2004/0187516 | A1 * | 9/2004 | Lee | F25C 5/22 62/340 |

(Continued)

FOREIGN PATENT DOCUMENTS

GB 2458784 A 10/2009

OTHER PUBLICATIONS

Non Final Office Action dated Jul. 22, 2020 for U.S. Appl. No. 16/299,730, "Wall Mounted Beverage Dispensing System", Lynch, 5 pages.

(Continued)

*Primary Examiner* — Benjamin R Shaw
(74) *Attorney, Agent, or Firm* — Lee & Hayes, P.C.

(57) ABSTRACT

This disclosure includes devices, systems, apparatuses, and implementations associated with a wall-mounted beverage dispensing system. The beverage dispensing system is configured to fit between standard space between studs. In some implementations, the studs may provide the sole support for the beverage dispensing system. The beverage dispensing system may include a filter that is accessible for replacement without the use for tools.

20 Claims, 17 Drawing Sheets

(56) References Cited

U.S. PATENT DOCUMENTS

2008/0184730 A1* 8/2008 Voglewede ..... F25D 23/126 222/566
2009/0242075 A1* 10/2009 Busick ..... C02F 1/325 141/85
2010/0308073 A1* 12/2010 Devilbiss ..... B67D 1/0014 62/236
2011/0079037 A1* 4/2011 Snider ..... F25D 23/00 62/67
2011/0126577 A1* 6/2011 An ..... B29C 45/00 222/129
2012/0091166 A1* 4/2012 An ..... F25D 23/126 222/146.6
2012/0138629 A1* 6/2012 Ashrafzadeh ..... G07F 13/065 222/1
2013/0104586 A1* 5/2013 Krause ..... F25D 23/12 222/146.2
2015/0028502 A1* 1/2015 Fanelli ..... B01F 35/833 261/140.1
2015/0060491 A1* 3/2015 Bird ..... F25D 23/126 222/146.6
2015/0275486 A1* 10/2015 Steward ..... B67D 1/0014 4/688
2016/0122173 A1* 5/2016 Ka ..... B01D 35/00 222/1
2017/0211872 A1* 7/2017 Goerz ..... B67D 1/0881
2017/0292782 A1 10/2017 Joyer et al.
2018/0179083 A1* 6/2018 Cooper ..... F25D 23/126
2018/0187964 A1 7/2018 Park et al.
2018/0299184 A1* 10/2018 Abeygunawardana ..... F25D 23/028
2019/0345018 A1* 11/2019 Garcia ..... B67D 3/0074
2020/0290860 A1* 9/2020 Lynch ..... B67D 1/16

OTHER PUBLICATIONS

The PCT Invitation to Pay Additional Fees dated May 18, 2020 for PCT Application No. PCT/US2020/016052, 14 pages.
The PCT Search Report and Written Opinion dated Jul. 9, 2020 for PCT Application No. PCT/US2020/016052, 21 pages.
The International Preliminary Report for Patentability for PCT Application No. PCT/US20/16052, dated Sep. 23, 2021.

* cited by examiner

WALL MOUNTED BEVERAGE DISPENSING SYSTEM

CROSS-REFERENCE TO RELATED APPLICATION

This application is a continuation of and claims priority to U.S. application Ser. No. 16/299,730, filed on Mar. 12, 2019 and entitled "WALL MOUNTED BEVERAGE DISPENSING SYSTEM," the entirety of which is incorporated herein by reference.

BACKGROUND

Beverage dispensing system, such as those that dispense municipal water, chilled water, filtered water, flavored water, and/or carbonated water are becoming more popular as individuals turn away from beverages packaged in disposable single use containers. Conventional beverage dispensers are either typically large and heavy commercial systems that are supported by a base positioned firmly on the ground or small counter top beverage coolers or heaters. Unfortunately, the large commercial systems typically require substantial floor space which is not ideal for all uses and the small counter top systems may not be suited to some kitchens with limited counter space. Additionally, the small conventional counter top systems typically often have only a one gallon or less reservoir that needs to be refilled after a small number of servings.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
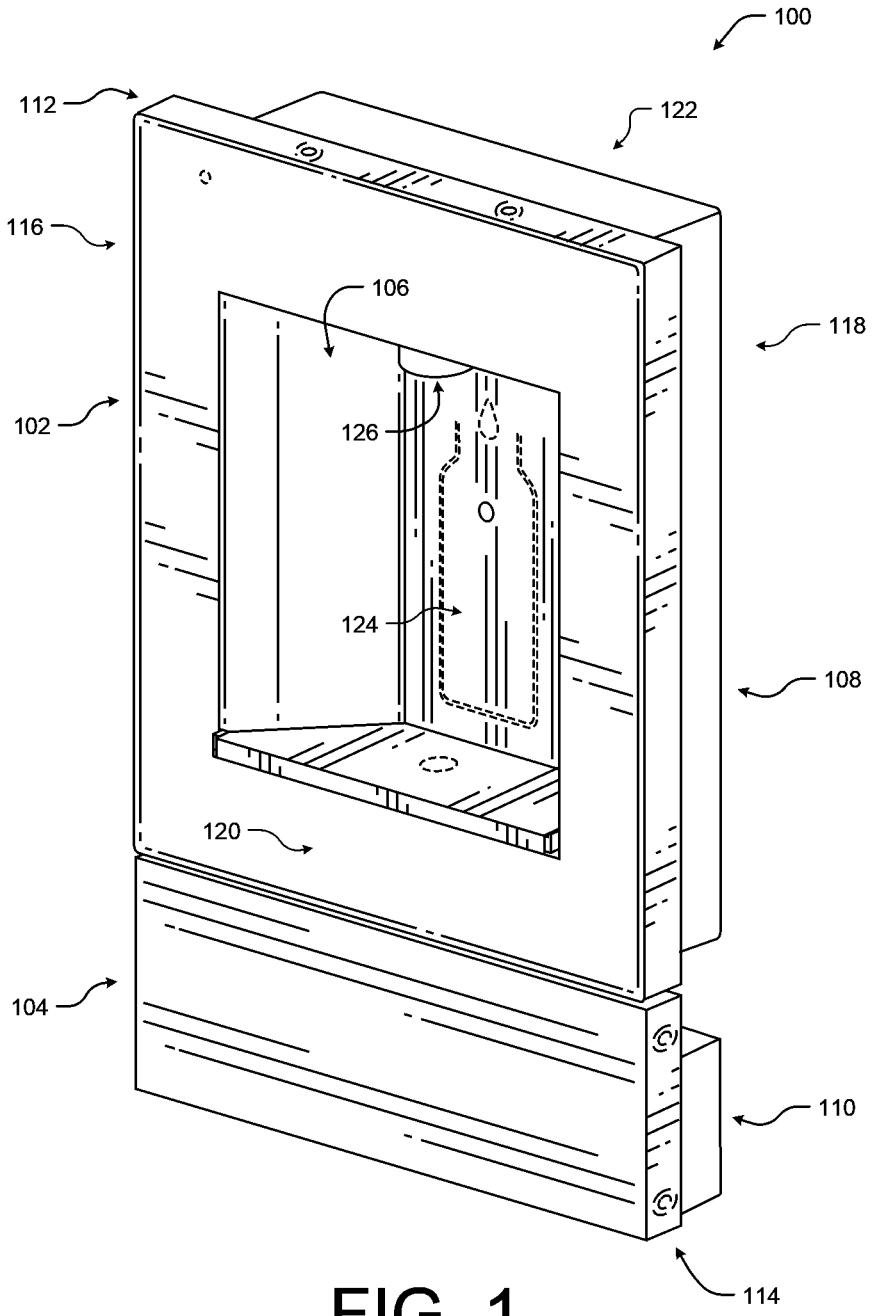
FIG. 1 illustrates an example perspective view of a water dispensing system according to some implementations.

This disclosure includes a plumbed beverage dispensing system and apparatus for mounting off the ground and in-wall within the common 16 inch stud spacing (e.g., 14.5 inches between each pair of studs) found in many types of construction, such that the studs may provide the sole support for the beverage dispensing system. Thus, unlike conventional dispensers that are supported by a base positioned firmly on the ground or placed on a counter top, the beverage dispensing system discussed herein may be located within the wall space of a structure, such as a home, thereby preventing the dispenser from occupying otherwise available space.

For instance, in some implementations, the beverage dispensing system may include an in-wall portion and a front portion that extends past the wall. In some instances, the in-wall portion may be less than or equal to approximately 14.5 inches from side to side and less than or equal to approximately 3.5 inches from front to back. Similarly, the front portion may be less than approximately 19.7 inches from side to side and less than or equal to approximately 1.2 inches from front to back.

In the current implementation, the in-wall portion of the beverage dispensing system may include a housing one or more liquid metering devices, one or more sensors, one or more drain features or components, one or more drip trays, one or more drip tray covers, one or more dispensed servings components, one or more electronics boards, one or more filter enclosures, one or more filter sensor systems as well as other components. In addition to the components, the dispenser may define an alcove for receiving a bottle or vessel. The alcove may be demarcated by a top member, a back wall member, and a bottom member formed from one or more of a spill tray and/or cover and extend at least partially into the wall space between the studs. In some cases, the alcove may include a middle area that includes the beverage dispensing nozzle. The middle area may be approximately 4.5 inches deep (e.g., from front to back) and approximately 5.5 inches wide. The alcove may also include a right area and a left area on either side of the middle area. The right area and the left area may have a depth that transitions from a position adjacent to the middle area and having a depth equal to the middle area to a position flush with the front of the system. In some examples, the alcove may be between approximately 9.9 inches and 13.8 inches tall, between approximately 9.9 inches and 13.8 inches wide, and between approximately 3.5 inches and 4.7 inches deep at the alcove's greatest depth. In some other examples, the alcove may be between approximately 11.4 inches and 12.6 inches tall, between approximately 11.4 inches and 12.6 inches wide, and between approximately 3.9 inches and 4.3 inches deep at the alcove's greatest depth.

In some cases, the beverage dispensing system may include a filter also disposed within the wall space but easily accessible to a user for replacement. For example, the beverage dispensing system may include an assembly, such as a drawer, positioned below the dispenser having a filter box. The drawer of the may be opened to allow the user access to a removable filter contained in the filter box. Thus, the filter may be accessed without the need for tools or to remove paneling or other components from the system. The filter box may be approximately 14.2 inches from side to side. In some specific cases, the filter box may be less than approximately 17.7 inches from side to side. The filter box may also be no greater than approximately 6.3 inches from top to bottom. The filter box may also be no greater than approximately 3.1 inches from front to back.

In general, the filter box may have an area for housing a filter that is approximately 12.6 inches by approximately 6.3 inches. In some specific implementations, the filter box may have an area that has a length (e.g., from side to side) of between approximately 9.8 inches and approximately 14.2 inches, a height (e.g., from top to bottom) that is between approximately 3.9 inches and approximately 9.8 inches, and a depth (e.g., front to back) that is between approximately 2.0 inches and approximately 3.5 inches.

In some cases, the filter may be configured to clean approximately 3,000 gallons of liquid (such as water) prior to replacement while fitting within the available wall space (e.g., having less than approximately 3.1 inches in diameter). In other cases, the filter may be configured to clean between approximately 2,800 gallons and approximately 3,200 gallons of liquid (such as water) prior to replacement while having a diameter less than approximately 3.5 inches. In some specific cases, the filter may be configured to clean greater than approximately 2,000 gallons or greater than approximately 2,500 gallons of liquid (such as water) prior to replacement while having a diameter of less than 3.5 inches.

In some cases, the filter or system may include one or more sensors that are capable of determining if the filter should be replaced. For example, the filter may expire based on a predetermined amount of time (which may be measured), a predetermined amount of filtered water (which may be measured), or when an amount of an active ingredient is below a predetermined threshold (e.g., carbon). In some cases, the dispensing system may be configured to provide a visual indication, such as a change filter light, on the system itself. The system may also be configured to communicate wirelessly with other electronic devices, such as a mobile phone, tablet, or personal computer, to provide a change filter alert.

In some implementations, the filters may be configured to couple, electrically or communicatively, to the dispensing system, such that the dispensing system may determine if the filter is new, the number of gallons the filter is configured to process, and if the filter is verifiably compatible for use with the system. Upon detection of a verified filter, the system may automatically reset the filter timer.

For example, the dispensing system may include one or more sensors, such as a flow sensor or proximity sensor, such that the dispensing system may begin to dispense a beverage by opening a valve associated with a beverage dispensing nozzle when a vessel is detected within an alcove of the dispensing system. The dispensing system may then stop dispensing the beverage by closing the valve associated with the beverage dispensing nozzle when the liquid level within the vessel has reached a desired height. In some cases, the amount of liquid dispensed by the dispensing system may be time based (e.g., liquid is dispensed for a predetermined period of time, such as seven seconds). In other cases, the amount of liquid (such as water) dispensed by the dispensing system may be amount based (e.g., liquid is dispensed in specified amounts, such as 1.0 liter, 2.0 liters, 8.0 ounces, 10 ounces, etc.).

In some cases, the system may also include additional sensors, such as contact sensors, moisture sensors, humidity sensors, etc., that may be placed in and around the alcove to detect an overflow event and to cause the system to close the beverage dispensing nozzle or active a shutoff valve in response to detecting the overflow event, thereby, preventing moisture from absorbing or contacting the walls of the structure. In some implementations, the sensors may be incorporated into the beverage dispensing nozzle and/or the back wall member of the alcove.

In some examples, the dispensing system may include a spill tray and drain feature configured to prevent moisture and/or liquid (such as water) from contacting or being absorbed by the walls of the structure. In some examples, the drain feature, including the drain and drain lines, may be configured to channel an amount of liquid equal to the normal flow rate of the dispenser, such that if the system dispensed liquid while a vessel was absent from the alcove, the drain feature may process the full flow without causing the spill tray to overflow. For example, the drain feature may process 200 ounces of liquid (such as water) per minute.

In some implementations, in addition to the oversized drain feature, the spill guard may include flashing having a back portion and a front portion. The back portion of the flashing may extend upward behind the back walls of the alcove and be at a height that is greater than the height of the front flashing. For instance, the back flashing may be greater than approximately 0.4 inches and the front flashing may be less than approximately 0.2 inches. In another instance, the back flashing may be greater than approximately 0.2 inches and the front flashing may be less than approximately 0.1 inches. In yet another instance, the back flashing may be between approximately 0.2 inches and approximately 0.8 inches and the front flashing may be between approximately 0.1 inches and approximately 0.4 inches. By including the flashing extending upward from the spill guard, the system is able to prevent liquid (such as water) from leaking between the wall of the alcove and the spill guard without the use of a sealants or gaskets.

The spill tray may also be configured to have a forward tilt to cause the water to move or flow towards the front of the system and out of the drain during an overflow event. For example, the spill tray may have a tilt of approximately 2.0 degrees. The front flashing also includes one or more weeping holes to allow excess liquid (such as water) to exit the spill tray out the front of the system. In this manner, any liquid (such as water) not processed by the drain feature may be directed out into the room and away from the walls behind and to the right and left of the system, thereby preventing, drywall, structural and/or electrical damage. In some cases, the weeping holes in the front flashing may be between approximately 0.2 inches and approximately 0.8 inches wide. In one specific example, the front flashing may have two weeping holes of approximately 0.4 inches wide.

In addition to the weeping holes, a spill tray cover is configured to be placed over the spill tray during use. A gap or space between the front flashing and the front face of the spill tray cover and between the top surface of the front flashing and the bottom surface of the spill tray cover are maintained to allow the liquid (such as water) exiting the weeping holes in the front flashing to flow between the front face of the cover and the front flashing of the spill tray. In some cases, the gaps between the front face of the cover and the front flashing of the spill tray may be between approximately 0.08 inches and approximately 0.2 inches. In one specific implementation, the gaps may be approximately 0.12 inches.

In one particular example, a sensor (such as a moisture sensor) may be located below the front flashing of the spill tray which may cause the system to generate an alert when liquid (such as water) overflows the spill tray. For example, the system may send a wireless signal to an owner's or site manager's electronic devices. In other cases, the system may activate one or more speakers with an audible alarm to draw the user's attention to the system and cause the user to inspect the system or the water lines and, thereby, prevent damage to the structure.

In some cases, the system may activate a shutoff valve after a continuous volume of liquid (such as water) has been detected exiting the system (e.g., either via the drain feature or over the front flashing of the spill tray). For example, if the system is outputting a normal flow but no vessel is available within the alcove, the liquid (such as water) may be removed from the spill stray via the drain feature but a sensor within the drain feature may cause the shutoff valve to close to prevent wasting large amounts of water. For instance, in various implementations, if the drain feature detects more than 10 ounces, more than 15 ounces, more than 20 ounces, or more than 25 ounces of continuous flow, the shutoff valve may be closed. Likewise, if the system detects continuous flow out of or over the front of the spill tray, the system may cause the shutoff valve to close to prevent water damage to the structure. Similar, in some implementations, if the drain feature detects more than 5.0 seconds, more than 7.0 seconds, more than 10 seconds, or more than 15 seconds of continuous flow, the shutoff valve may be closed.

In some implementations, the beverage dispensing system may include lighting source(s). In some cases, the lighting source may be incorporated into the beverage dispensing nozzle. The lighting source may be configured to scale in intensity based on a fullness level of the bottle or vessel being filled. For example, the lighting source may increase in intensity over time as the beverage dispensing nozzle dispenses liquid. In another example, the lighting source may increase in intensity based on the strength of a signal from a sensor (e.g., as the liquid (such as water) in the bottle or vessel approaches the beverage dispensing nozzle, the intensity of the light source may increase). In some case, the increase in intensity of the light source may be configured to increase in a uniform manner, while in other cases, the rate or intensity change may increase as the vessel fills. In this manner, the system is able to notify the user when the vessel is approaching a full state and prevent unnecessary spills. In another implementation, rather than a light source, a speaker may be included that outputs an audio signal having a sound level based on the level of fill of the vessel.

FIG. 1 illustrates an example perspective view of a beverage dispensing system 100 according to some implementations. In the current implementation, the beverage dispensing system 100 may include a dispenser 102 and a filter unit 104 positioned below the dispenser 102. In general, the dispenser 102 may include an alcove 106 that includes a beverage dispensing nozzle 126 housing a solenoid or valve that may be opened to dispense liquid (such as water) into a vessel, such as a bottle or cup, (not shown) within the alcove 106.

In general, both the dispenser 102 and the filter unit 104 may be configured to fit between standard residential sixteen-inch stud spacing, such that the dispensing system 100 is wall mountable. Thus, the dispensing system 100 is positioned off or above the ground (e.g., the dispensing system 100 is not supported by a base member that rests in contact with the ground). When mounted within the studs, both the dispenser 102 and the filter unit 104 include an in-wall portion 108 and 110, respectively, that is concealed from view within the space between the studs and a front portion 112 and 114, respectively, that extend outward toward a user from a surface of the wall.

As the in-wall portions 108 and 110 are designed to fit within the space between two studs without requiring modification to the structure (e.g., cutting of the studs), the in-wall portions 108 and 110 may have a width (e.g., from a first side 116 to a second side 118 of the system 100) that may be less than or equal to approximately 14.6 inches and a depth (e.g., from a front side 120 to a back side 122 of the system 100) that is less than or equal to approximately 3.5 inches. In another example, the in-wall portions 108 and 110 may have a width that may be between approximately 14.5 inches and approximately 10.6 inches and a depth between approximately 2.8 inches and approximately 3.9 inches. Similarly, in some cases, the front portion 112 may have a width of approximately 17.7 inches, a height of approximately 20.1 inches, and a depth of approximately 1.2 inches. In other cases, the front portion 112 may have a width of between approximately 30 centimeters or 11.8 inches and approximately 19.7 inches, a height of between approximately 11.8 inches and approximately 23.6 inches, and a depth between approximately 0.8 inches and approximately 1.9 inches. The front portion 114 may have a width of approximately 17.7 inches, a height of approximately 6.3 inches, and a depth of approximately 1.2 inches. In other cases, the front portion 114 may have a width of between approximately 15.7 inches and approximately 19.7 inches, height between approximately 3.9 inches and approximately 7.9 inches, and a depth between approximately 0.8 inches and approximately 2.0 inches.

In the illustrated example, the alcove 106 extends from the front 120 of the system 100 into the in-wall portion 108 towards the back 122 of the system 100. The alcove 106 may be defined by a top member, a back wall member, and a bottom member formed from one or more of a spill tray and/or cover and extend at least partially into the wall space between the studs. In some cases, the alcove 106 may have a maximum depth from the opening in the front portion 112 to a back wall member, generally indicated by 124, that is approximately 4.3 inches. The alcove 106 may also have a width of approximately 4.3 inches and a height of approximately 12.6 inches. Thus, the alcove 106 may comfortably receive a vessel and a hand of a user.

The dispensing system 100 may be formed of any suitable material. For example, the dispensing system 100 may be formed from stainless steel, other metallic materials, various polymer, various plastics, as well as other materials.

Figure 2:
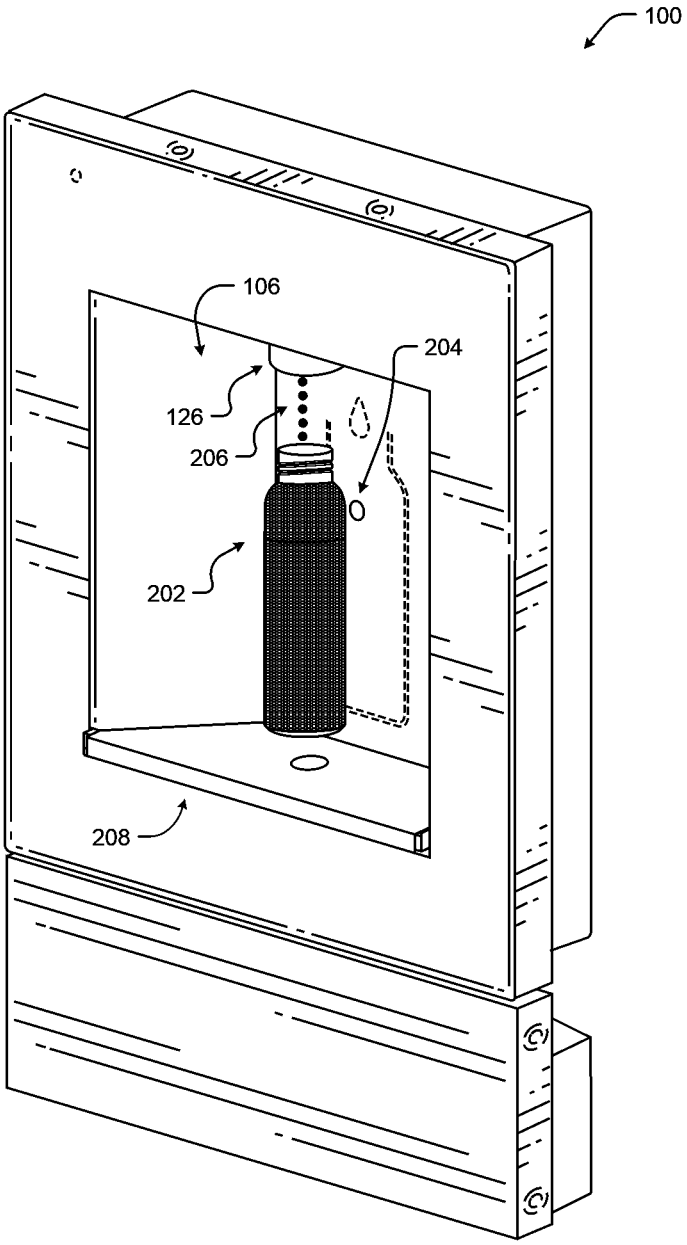
FIG. 2 illustrates another example perspective view of a beverage dispensing system according to some implementations.

FIG. 2 illustrates another example perspective view of a beverage dispensing system 100 according to some implementations. In the illustrated example, a vessel 202 has been positioned within the alcove 106, such that a sensor 204 (for instance, a proximity sensor) positioned along the back wall of the alcove 106 is able to detect the presence of the vessel 202 and, in some cases, to cause the solenoid within the beverage dispensing nozzle 126 to open and dispense liquid (such as water) 206 into the vessel 202. In some cases, the sensor 204 may determine that the vessel 202 is in the correct position prior to dispensing the liquid (such as water) 206 to prevent unnecessary spilling.

In some cases, the orifice of the solenoid may be variable, such that the flow rate of the liquid (such as water) out of the beverage dispensing nozzle 126 may be adjustable. In one example, the flow rate may be slowed as the vessel 202 is filled by partially closing the solenoid while the system 100 dispenses the liquid (such as water) 206. For instance, a flow sensor (not shown) may be configured to measure the amount of liquid (such as water) dispensed by the beverage dispensing nozzle 126 and upon dispensing predetermined or user defined threshold amounts of liquid (such as water) 206 (e.g., 3.0 ounces, 5.0 ounces, 7.0 ounces, 9.0 ounces, etc.), the flow sensor may generate a signal causing the solenoid to reduce the size of the orifice. In other cases, the solenoid may reduce the size of the orifice or reduce the flow rate after a predetermined or user defined threshold period of time has elapsed.

In some implementations, additional sensors (not shown) may be positioned along the top surface of the alcove 106 to assist in determining if the vessel 202 is positioned correctly with respect to the beverage dispensing nozzle 126 prior to opening the solenoid and dispensing the liquid (such as water) 206. A removable drain cover 208 may be positioned opposite the top surface of the alcove 106 to hide or keep a spill tray (not shown) out of view of a user, while allowing access to the spill tray when removed. In some cases, the additional sensors may be proximity sensors, contract sensors, touch sensors, electrical conductivity sensors (such as capacitive or resistive based sensors).

Figure 3:
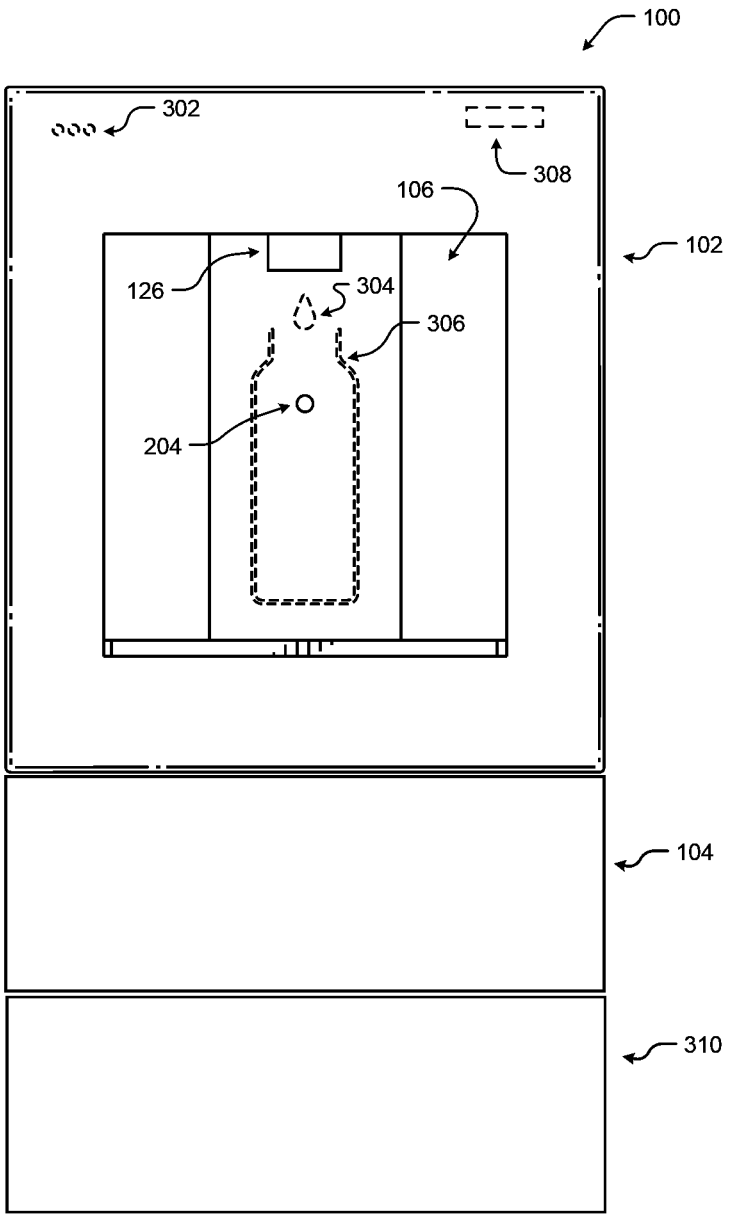
FIG. 3 illustrates an example front view of the beverage dispensing system according to some implementations.

FIG. 3 illustrates an example front view of the beverage dispensing system 100 according to some implementations. In the illustrated example, the dispenser 102 may also include various user indicators, such as one or more of lights 302, 304, 306, and 308. For example, the system 100 may be configured to increase or decrease the intensity of the lights 302, 304, 306, and 308 as the vessel is filled with liquid (such as water) dispensed from the beverage dispensing nozzle 126. For example, the sensor 204 may capture data usable to detect a level of fill associated with a vessel in the alcove 106, such that the system 100 may modify the intensity of the lights 302, 304, 306, and 308 based on the fill level of the vessel. In other examples, the intensity of the lights 302, 304, 306, and 308 may be varied based on a time period (such as 5.0 seconds, 7.0 seconds, 10 second, 15 seconds, etc. of continuous flow) or an amount of liquid (such as water) dispensed (such as 2.0 liters, 8.0 ounces, 10 ounces, etc.).

In the illustrated example, the system 100 may also include an additional drawer or compartment 310 below the filter unit 104. For example, the system 100 may include an optional ice drawer, ice maker, or storage space as part of the wall mounted system 100. In other examples, the compartment 310 may be located above the dispenser 102 or between the dispenser 102 and the filter unit 104. Additionally, it should be understood that in some implementations, the filter unit 104 may be positioned remote of the wall mounted dispenser 102 such that the wall space occupied by the filter unit 104 may be used for an ice drawer, ice maker, or storage. In another example, it should be understood that the filter unit 104 may be arranged in different positions relative to the dispenser 102, such as, for instance, above the dispenser 102.

Figure 4:
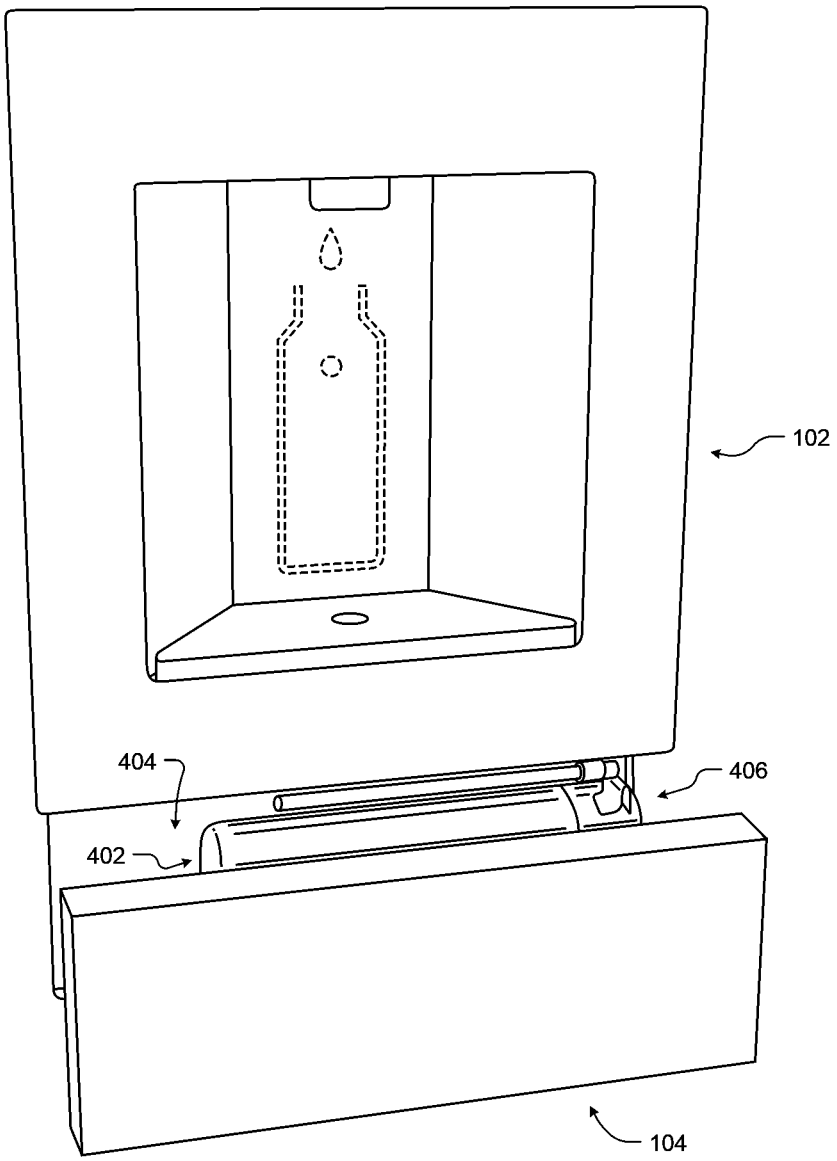
FIG. 4 illustrates an example perspective view of a beverage dispensing system with an open filter unit for accessing a filter according to some implementations.

FIG. 4 illustrates an example perspective view of a beverage dispensing system 100 with an open filter unit 104 for accessing a filter 402 according to some implementations. Since the beverage dispensing system 100 is wall mounted within the space between studs, the filter 402 may be difficult to access if located behind a front panel of the dispenser 102. Thus, the system 100 discussed herein, includes a filter unit 104. The filter unit 104 may be configured as a drawer that may be opened by a user to allow the user to access a filter box 404 that includes a filter port 406. The filter port or head 406 may be configured to allow the filter 402 to be coupled and decoupled from the system 100. For instance, the filter 402 may be mechanically and/or electrically coupled and/or decoupled to the filter port 406 by the user when the filter unit 104 is open and the filter box 404 is exposed. In some cases, the filter port 406 may be configured to auto seal when the filter 402 is decoupled. The auto seal prevents leaks that may result from operating the system 100 without a filter 402 attached.

In some cases, the filter 402 may be configured to clean approximately 3,000 gallons of liquid (such as water) prior to replacement while fitting within the available wall space (e.g., having less than approximately 3.14 inches in diameter). In other cases, the filter 402 may be configured to clean between approximately 2,800 gallons and approximately 3,200 gallons of liquid (such as water) (such as water) prior to replacement while being less than approximately 3.5 inches in diameter.

In some cases, the filter box 404 may include one or more sensors (not shown) that are capable of determining the filter 402 should be replaced. For example, the filter 402 may expire based on a predetermined amount of time (which may be measured), a predetermined amount of water filtered (which may be measured), or when an amount of an active ingredient is below a predetermined threshold (e.g., carbon). In some cases, the beverage dispensing system 100 may be configured to provide a visual indication, such as a change filter light, on the system 100 itself that the filter 402 needs to be replaced. The system 100 may also be configured to wirelessly communicate with other electronic devices, such as a mobile phone, tablet, or personal computer, to provide a change filter alert.

In some implementations, the filter 402 may be configured to electrically or communicatively couple to the beverage dispensing system 100 via the port 406, such that the beverage dispensing system 100 may determine if the filter 402 is new, the number of gallons the filter 402 is configured to process, and if the filter 402 is authorized for use with the system 100. Upon detection of the new authorized filter 402, the system 100 may automatically reset a filter timer.

The filter box 404 is configured to be positioned within the wall when closed. In some cases, the filter box 404 may be approximately 14.2 inches from side to side (e.g., from stud to stud). The filter box 404 may also be less than approximately 6.3 inches from top to bottom. The filter box 404 may also be less than approximately 3.1 inches from front to back (e.g., deep).

Figure 5:
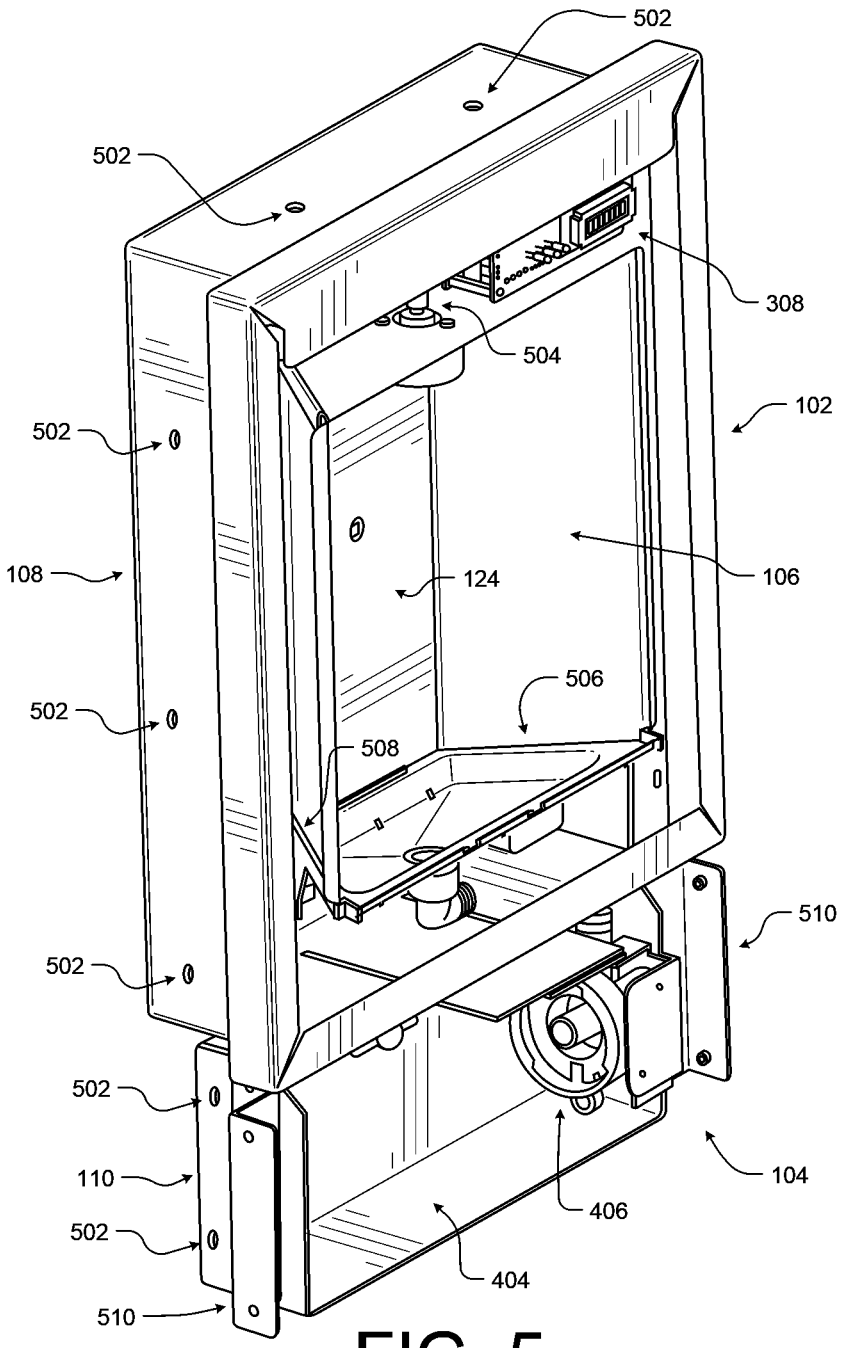
FIG. 5 illustrates an example perspective view of the beverage dispensing system with front paneling removed according to some implementations.
Figure 6:
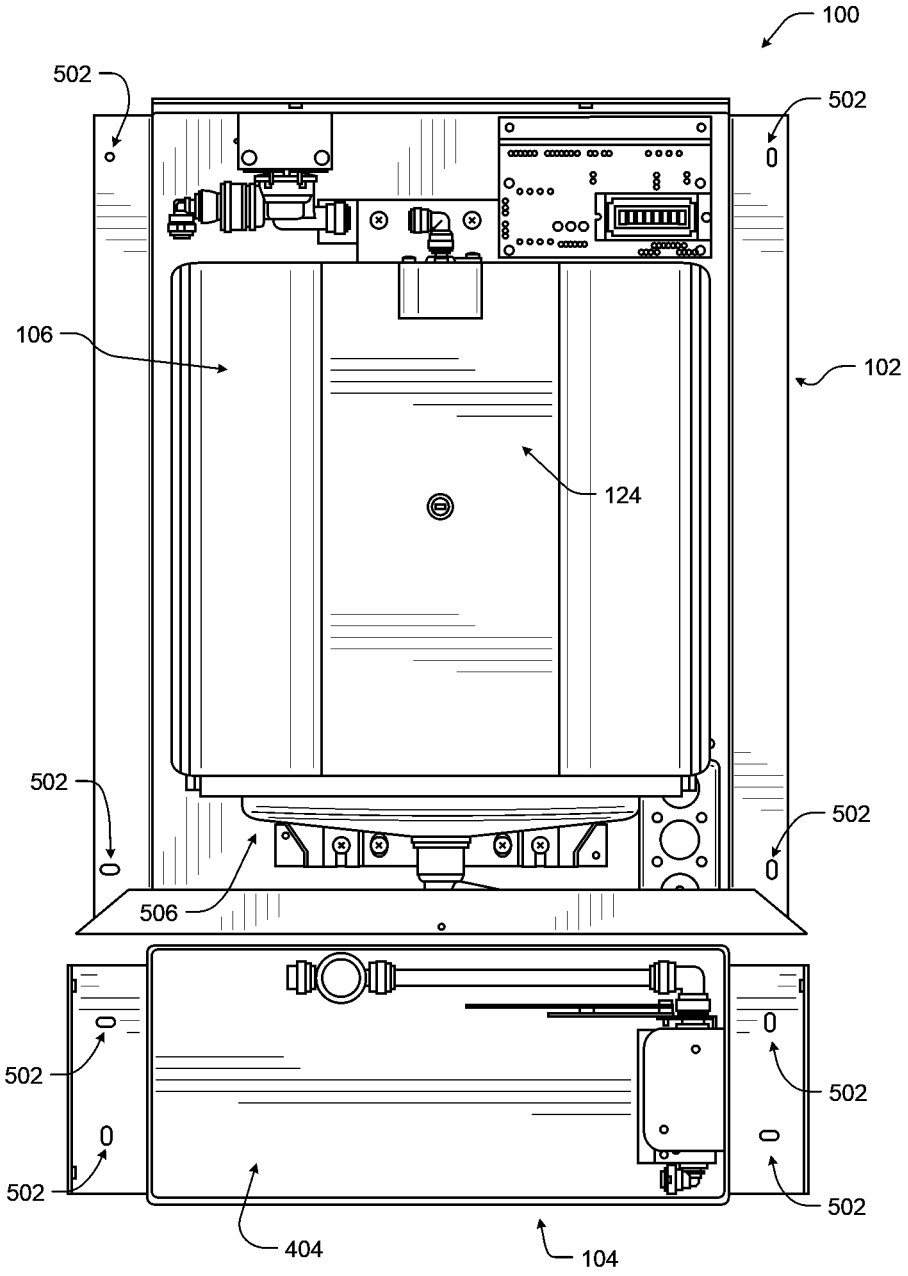
FIG. 6 illustrates an example front view of the beverage dispensing system with front paneling removed according to some implementations

FIG. 5 illustrates an example perspective view of the beverage dispensing system 100 with front paneling removed according to some implementations and FIG. 6 illustrates an example front view of the beverage dispensing system 100 with front paneling removed according to some implementations. As discussed above, the system 100 is configured to mount between the studs. Thus, in the current example, a number of mounting ports, generally indicated by 502, are located around the exterior of the in-wall portion 108 of the dispenser 102 and the in-wall portion 110 of the filter unit 104. It should be understood that the mounting ports 502 may be configured for any type of faster for coupling the system 100 to the walls, such as screws, bolts, hooks, etc.

In the current example, the solenoid 504 and the spill tray 506 are visible. For example, the spill tray 506 may include flashing 508 that may extend upwards from the tray 506 behind the wall 124 of the alcove 106 to prevent liquid (such as water) from leaking or seeping into the wall without the use of a gasket that may wear out. The spill tray 506 will be described in further detail below with respect to FIG. 15. In the current example, the filter box 404 is also visible as the drawer of the filter unit 104 has been removed from the drawer brackets 510. In the current example, the filter has been decoupled from the filter port 406.

Figure 7:
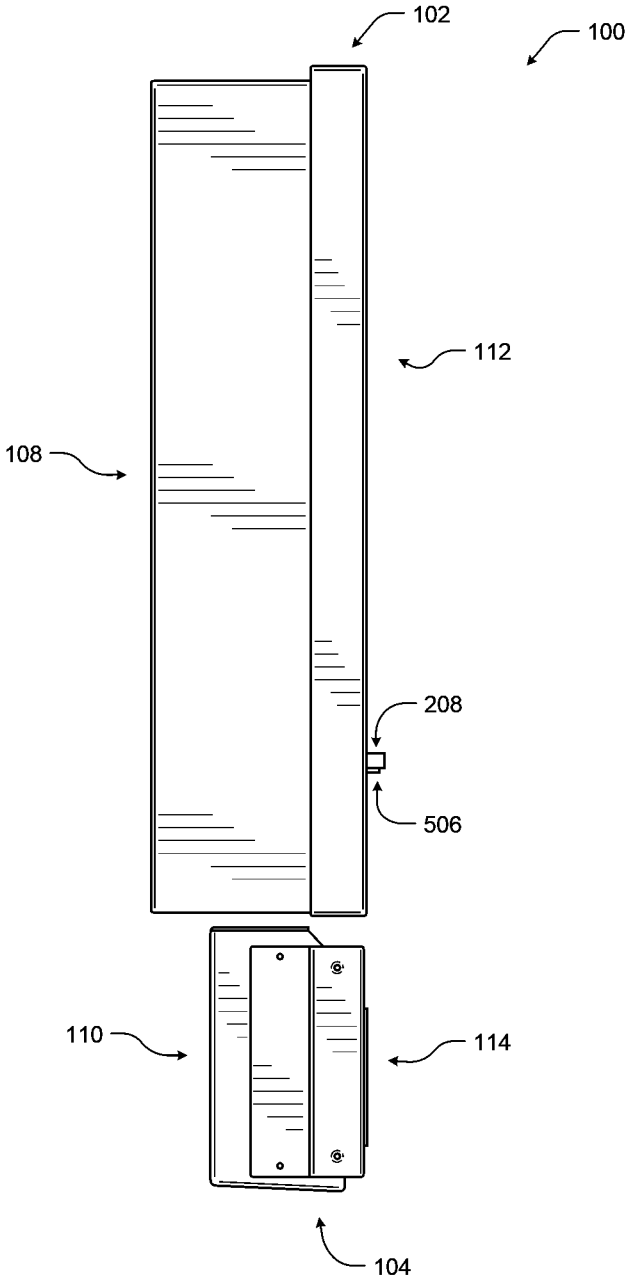
FIG. 7 illustrates an example side view of the beverage dispensing system according to some implementations.

FIG. 7 illustrates an example side view of the beverage dispensing system 100 according to some implementations. In the current example, the in-wall portions 108 and 110 as well as the front portions 112 and 114 of the dispenser 102 and the filter unit 104 are shown. Thus, as illustrated, the system 100 may mount within the walls, such that the in-wall portions 108 and 110 are within the wall space and a back surface of the front portions 112 and 114 are in contact with the wall and the front portions 112 and 114 extend forward into the room. In some cases, the system 100 may extend into the room by approximately 41.8 inches. In other case, the system 100 may extend into the room by between approximately 0.8 inches and approximately 2.3 inches.

In the illustrated example, the spill tray 506 and/or cover 208 may extend past the front surface of the front portion 112 of the dispenser 102. For instance, the spill tray 506 and/or cover 208 may extend past the front portion 112 to cause liquid (such as water), in the occasion of an overflow event to flow out of the front of the system 100 rather than backward into the wall, thereby reducing risk of water damage to the structure or building. In some cases, the spill tray 506 and/or cover 208 may extend approximately 1.0 centimeter past the front portion 112. In other cases, the spill tray 506 and/or cover 208 may extend between approximately 0.2 inches and 0.8 inches past the front portion 112.

Figure 8:
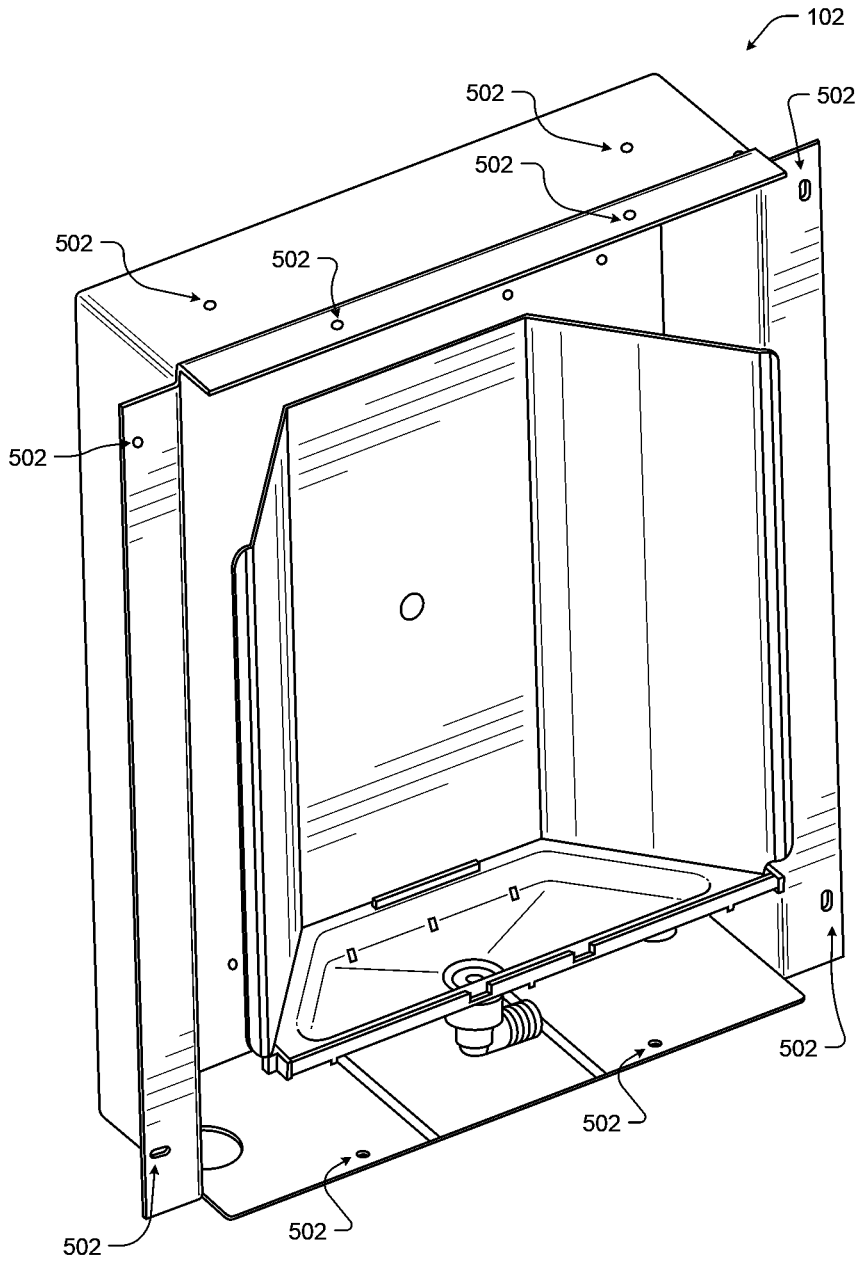
FIG. 8 illustrates an example perspective view of the beverage dispensing system with a drain cover and front paneling removed according to some implementations.

FIG. 8 illustrates an example perspective view of the beverage dispensing system 100 with a drain cover and front paneling removed according to some implementations. In the current example, an alternate arrangement of the mounting ports 502 is illustrated. Thus, it should be understood to one skilled in the art that the mounting ports 502 may be located at various locations and positioned and take various forms to attach to the studs.

Figure 9:
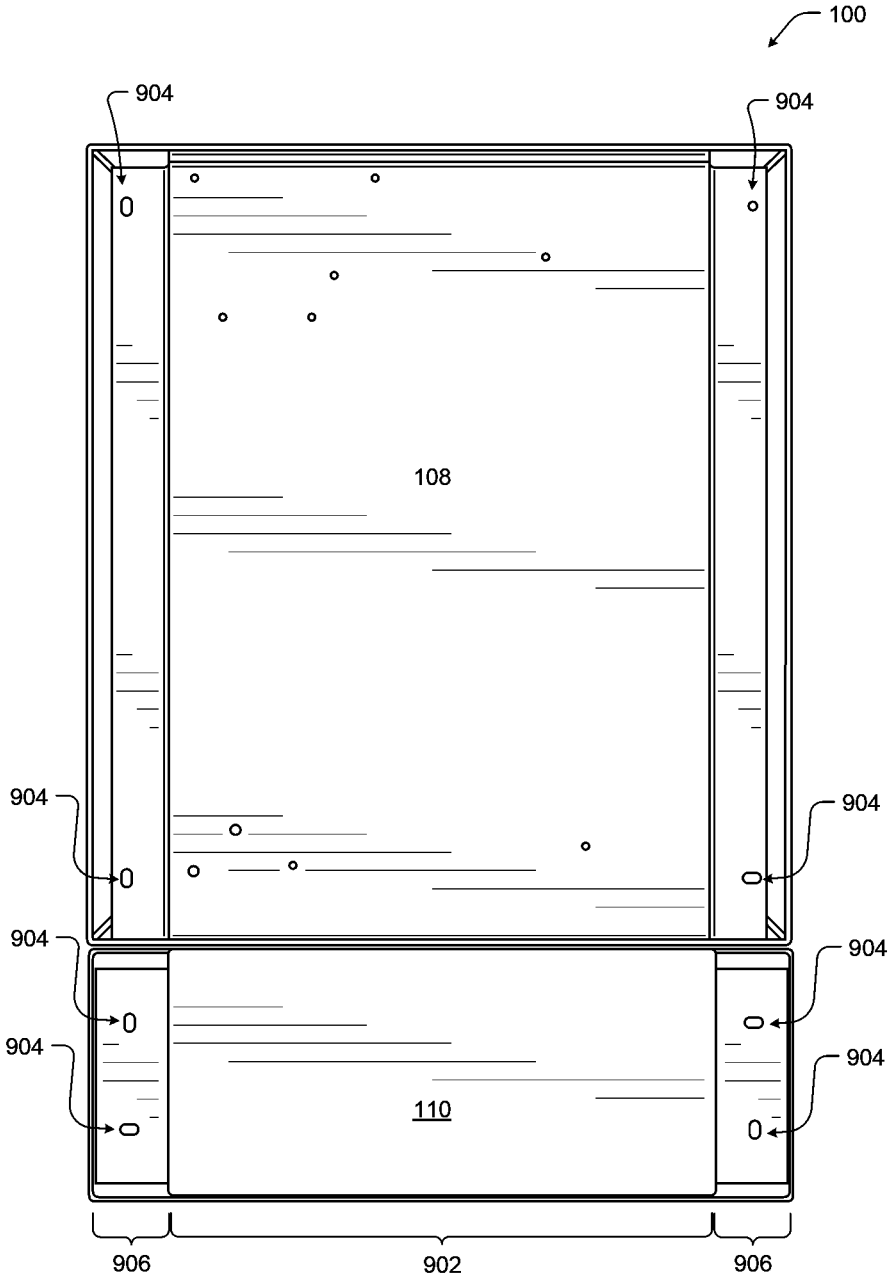
FIG. 9 illustrates an example rear view of the beverage dispensing system according to some implementations.

FIG. 9 illustrates an example rear view the beverage dispensing system 100 according to some implementations. As discussed above, the in-wall portions 108 and 110 are configured to fit between two studs of a structure. Thus, the in-wall portions 108 may have a length 902 that is approximately 13.8 inches. On either side of the in-wall portions 108 and 110 may include mounting ports, generally indicated by 904, and configured to mount on a front surface of a stud. Thus, on either side of the in-wall portions 108 and 110 is a width, generally indicated by 906, for receiving the stud. The widths 906 may be approximately 1.6 inches.

Figure 10:
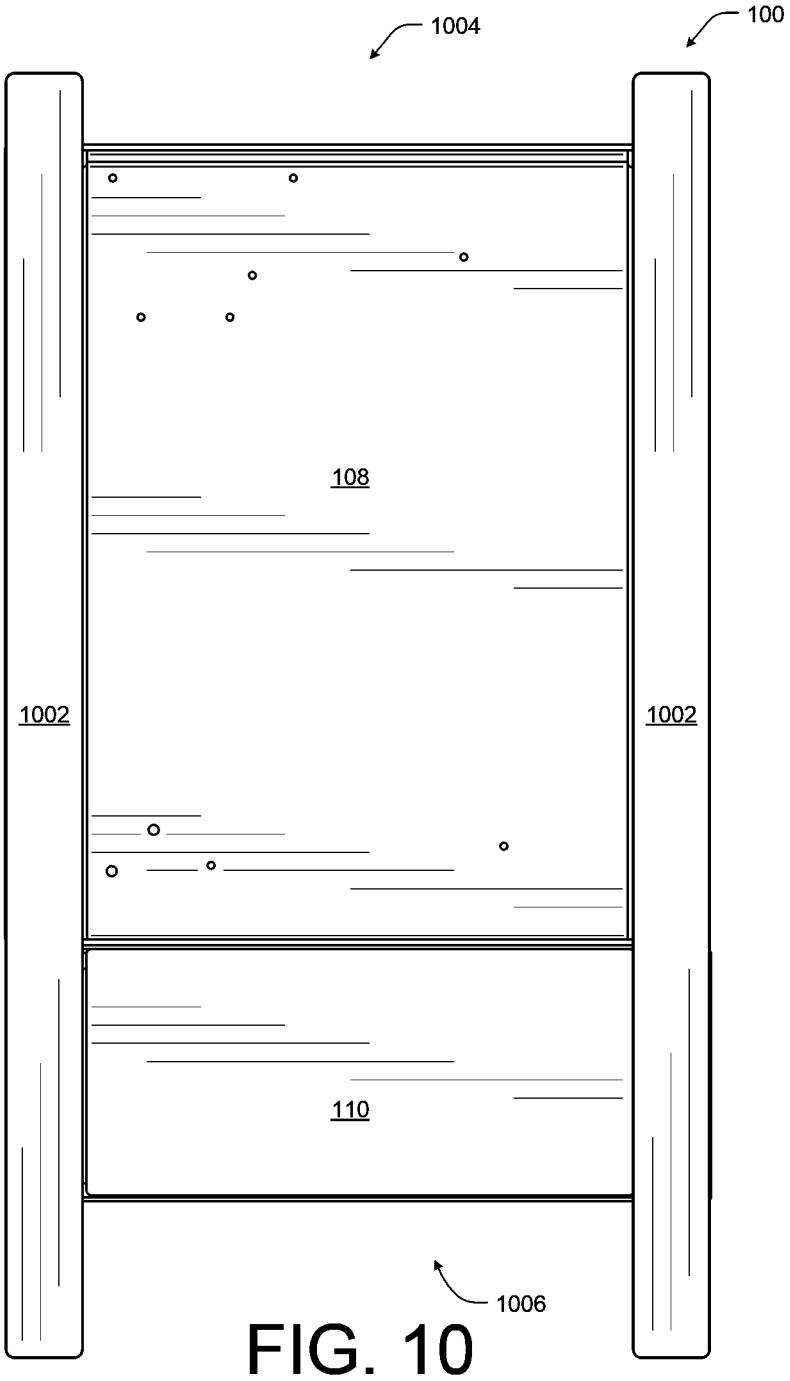
FIG. 10 illustrates another example rear view the beverage dispensing system according to some implementations.

FIG. 10 illustrates another example rear view of the beverage dispensing system 100 according to some implementations. In the current example, the system 100 has been installed between two studs 1002. When installed, additional wall space 1004 above the system 100 and wall space 1006 below the system 100 may be available for additional hardware coupled to the system 100, such as pipes, chillers, heaters, additional filters, etc.

Figure 11:
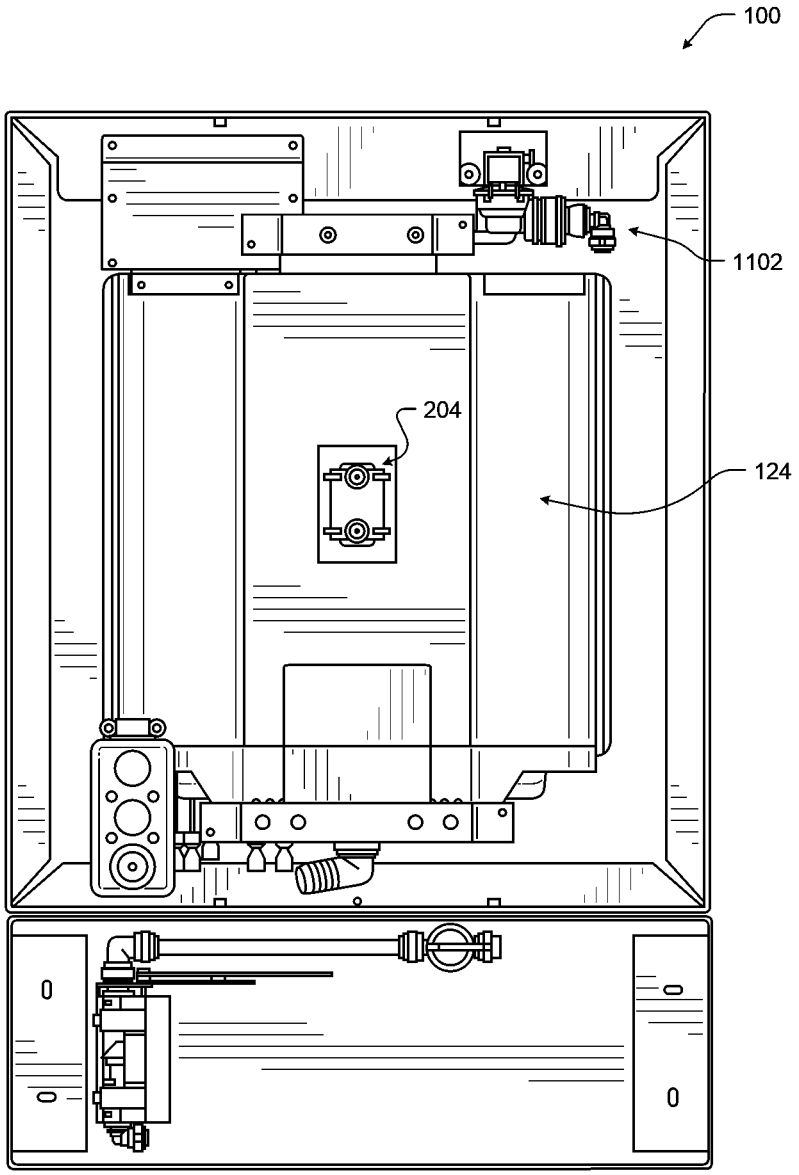
FIG. 11 illustrates an example rear view the beverage dispensing system with rear paneling removed according to some implementations.

FIG. 11 illustrates an example rear view the beverage dispensing system 100 with rear paneling removed according to some implementations. In the current example, multiple sensors 204 may be incorporated into or located behind the wall 124 of the alcove (not shown). The sensors 204 may be configured to detect the presence of a vessel, a fill level of the vessel, an overflow event, a continuous flow event, etc. In general, the system 100 may be coupled to cold water plumbing via the liquid (such as water) intake system 1102. Thus, the system 100 does not require any reservoir, such as is common in conventional counter top water dispensers. Additionally, the solenoid may be positioned close to the outlet (to mitigate air infiltration in the line which reduces the likelihood of leaks or drips. The water lines may be small (e.g., less than approximately 0.004 inches) to prevent water stagnating or warming after passing through the chiller.

Figure 12:
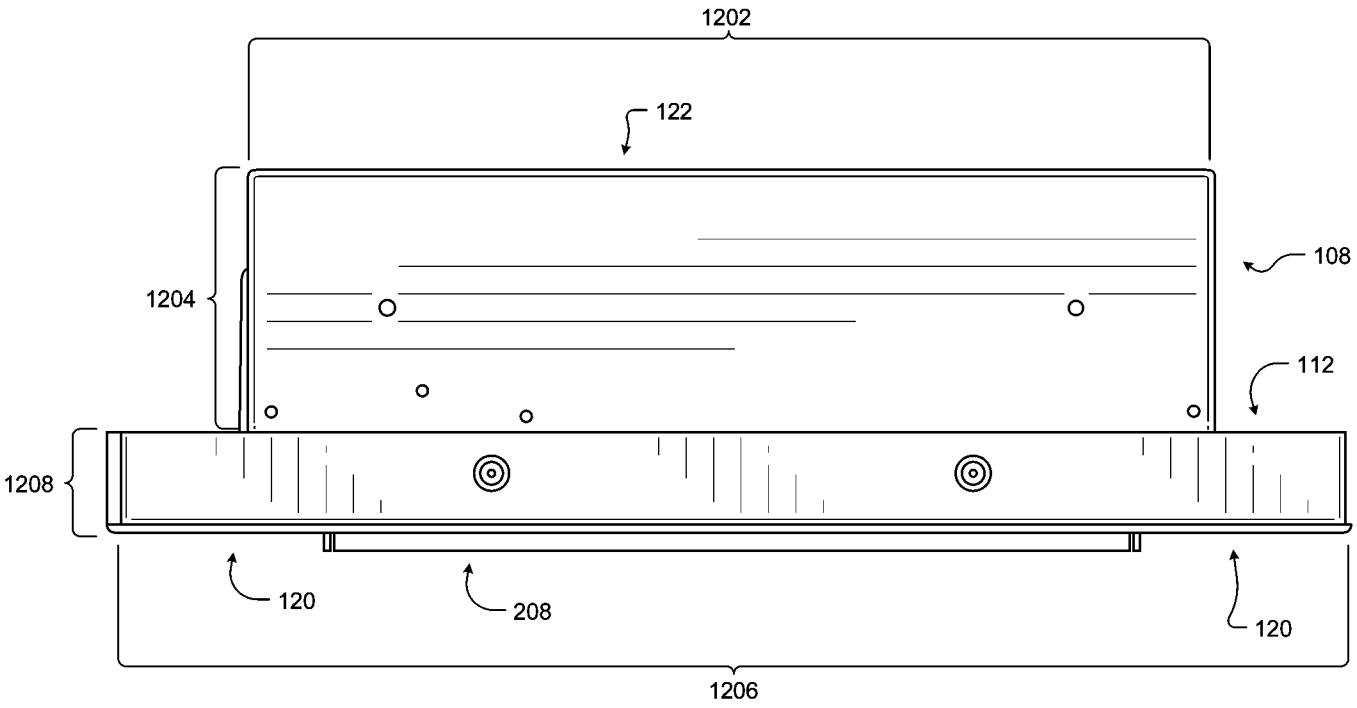
FIG. 12 illustrates an example bottom view of the beverage dispensing system 100 according to some implementations.

FIG. 12 illustrates an example bottom view of the beverage dispensing system 100 according to some implementations. In the illustrated examples, the in-wall portion 108 may have a length 1202 that is less than or equal to approximately 14.5 inches and a depth 1204 that is less than or equal to approximately 3.5 inches. Similarly, the front portion 120 may have a length 1206 that is less than or equal to approximately 17.7 inches and a depth 1208 that is less than or equal to approximately 1.18 inches.

Figure 13:
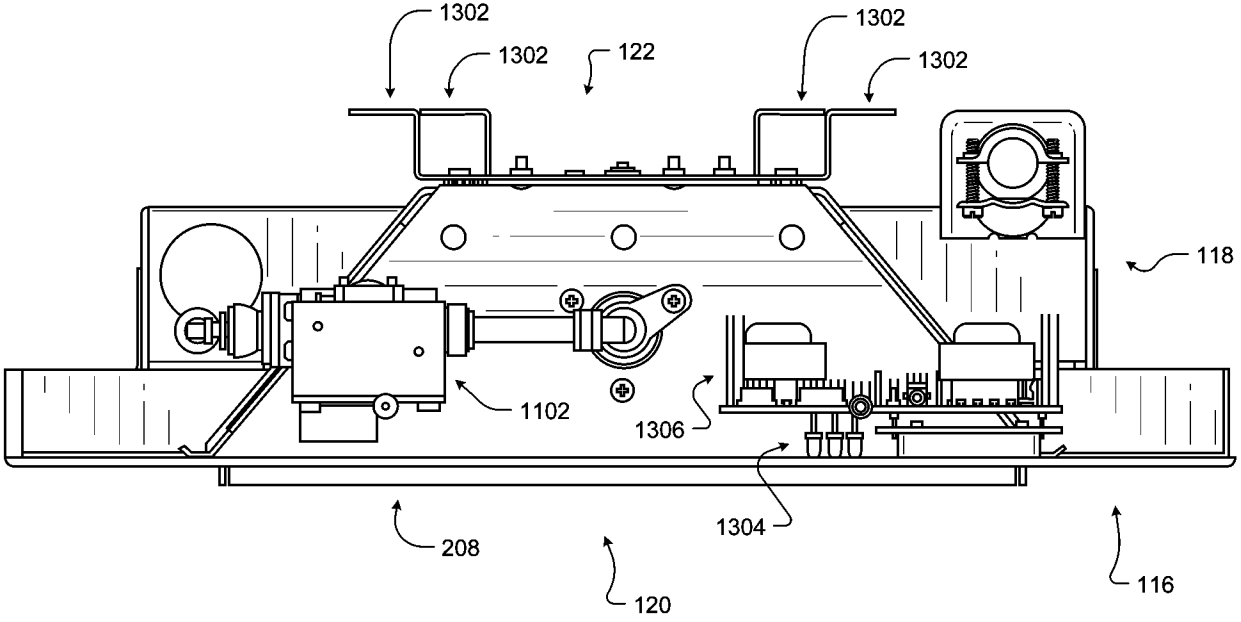
FIG. 13 illustrates an example top view of the beverage dispensing system according to some implementations.

FIG. 13 illustrates an example view of the beverage dispensing system 100 according to some implementations. In the current example, the system 100 illustrates a liquid (such as water) intake system 1102 coupled to the liquid metering devices for dispensing via the beverage dispensing nozzle. Additionally, in the current example, various rear optional mounting brackets 1302 are shown, as well as lighting sources 1304 and control circuits 1306.

Figure 14:
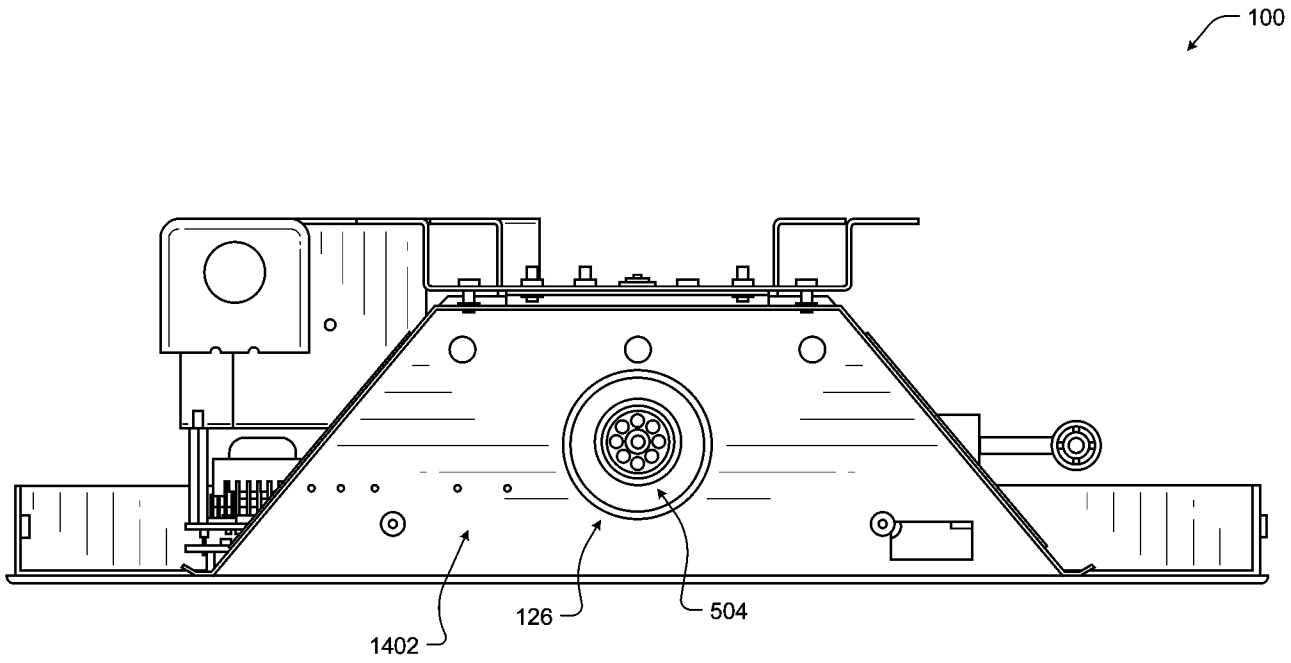
FIG. 14 illustrates is an example cross section view of the beverage dispensing system according to some implementations.

FIG. 14 illustrates is an example cross section view of the beverage dispensing system 100 according to some implementations. In the current example, the beverage dispensing nozzle 126 includes one or more liquid metering devices 504 that may open to dispense liquid (such as water) is shown within a top member 1402. The top member 1402 together with the back wall member, and the spill tray defining the alcove.

Figure 15:
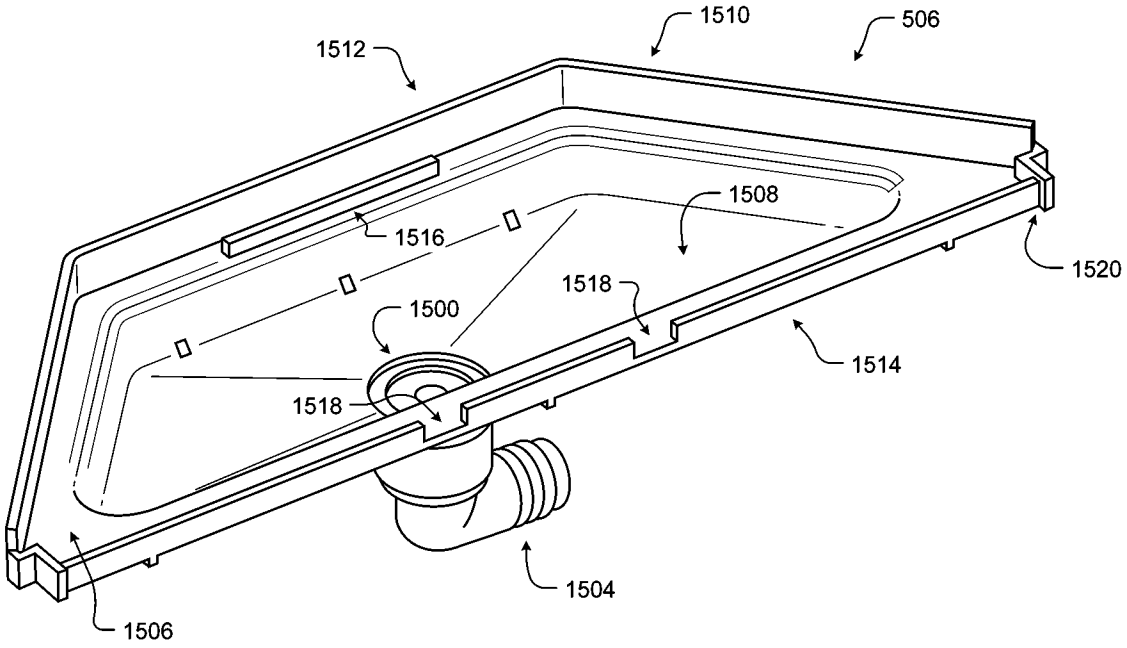
FIG. 15 illustrates an example perspective view of the spill tray and drain of the beverage dispensing system according to some implementations.

FIG. 15 illustrates an example perspective views the spill tray 506 and drain feature 1500 of the beverage dispensing system 100 according to some implementations. In general, the spill tray 506 and drain feature 1502 may be configured to prevent moisture and/or water from contacting or being absorbed by the walls of the structure. In some examples, the drain feature 1502, including the drain and drain lines, generally indicated by 1504, may be configured to channel an amount of liquid (such as water) equal to or greater than the normal flow rate of the dispenser (e.g., the beverage dispensing nozzle and liquid metering devices). For instance, the spill tray 506 may also include a raised area 1506 and a basin 1508. The drain feature 1502 may be mechanically coupled to the spill tray 506 at the lowest position along the basin 1508, such that excess liquid (such as water) will collect in the basin 1508 and flow out the drain feature 1502. Thus, if the system 100 dispensed liquid (such as water) while a vessel was absent from the alcove, the basin 1508 may collect and the drain feature 1502 may process the full flow without causing the spill tray 506 to overflow. For example, the drain feature 1502 may process approximately 2.0 gallons of liquid (such as water) per minute.

In some implementations, in addition to the drain feature 1502, the spill tray 506 may be designed to cause excess moisture or liquid (such as water) to exit the system 100 from the front to prevent damages to the walls. For instance, the spill tray may include flashing 1510 having a back portion 1512 and a front portion 1514. The back portion 1512 of the flashing 1510 may be at a height that is greater than the height of the front portion 1514 of the flashing 1510, as illustrated. For instance, the back portion 1512 of the flashing 1510 may be greater than approximately one centimeter and the front portion 1514 of the flashing 1510 may be less than approximately 0.2 inches. In another instance, the back portion 1512 of the flashing 1510 may be greater than approximately 0.2 inches and the front portion 1514 of the flashing 1510 may be less than approximately 0.01 inches. In yet another instance, the back portion 1512 of the flashing 1510 may be between approximately 0.2 inches and approximately 0.8 inches and the front portion 1514 of the flashing 1510 may be between approximately 0.1 inches and approximately 0.4 inches.

In some cases, the back portion 1512 of the flashing 1510 may be configured to extend upward behind the back wall (not shown) of the alcove. For instance, the wall of the alcove may be configured to fit between the flashing 1510 and a member 1516 of the spill tray 506 while resting on the raised area 1506. In this manner, the spill tray 506 and the wall of the alcove may mate or lock with each other without the use of adhesives or fasteners. In some cases, the back wall mating member 1516 may be between 0.1 inches and 0.4 inches in height and between 1.6 inches and 3.9 inches in length. Additionally, the flashing 1510, discussed herein, also allows for a water tight seal without the use of caulk, a gasket, or other sealant along the seam between the wall of the alcove and the spill tray 506. Thus, by including the flashing 1510 extending upward from the spill tray 506, the system 100 is able to prevent liquid (such as water) from leaking into the wall of the structure and, thereby, causing damage.

In the illustrated implementation, the spill tray 506 may also be configured to have a forward tilt to cause the liquid (such as water) to move or flow towards the front of the system 100 during an overflow event. For example, the spill tray 506 may have a tilt of approximately 2.0 degrees. The tilt may cause excess liquid (such as water) to flow out of the system 100 via the front rather than backwards into the wall of the structure. The front portion 1514 of the flashing 1510 also includes one or more weeping holes 1518 to encourage the excess liquid (such as water) to exit the spill tray 506 out the front of the system 100. In this manner, any liquid (such as water) not processed by the drain feature 1502 may be directed out into the open space of the structure and away from the walls behind and to the right and left of the system 100, thereby preventing drywall, structural and/or electrical damage to the structure. In some cases, the weeping holes 1518 in the front portion 1514 of the flashing 1510 may be between approximately 0.5 centimeters or 0.2 inches and approximately 0.8 inches. In one specific example, the front portion 1514 of the flashing 1510 may have two weeping holes 1518 of approximately 0.4 inches.

In some cases, a spill tray cover 208 (not shown) is configured to be placed over the spill tray 506 during use. A capillary action disruption space, generally indicated by 1520, between the front portion 1514 of the flashing 1510 and the front face of the spill tray cover (not shown) is maintained to allow the liquid (such as water) exiting the weeping holes 1518 in the front portion 1514 of the flashing 1510 to flow between the front face of the cover and the front portion 1512 of the flashing 1510.

Figure 16:
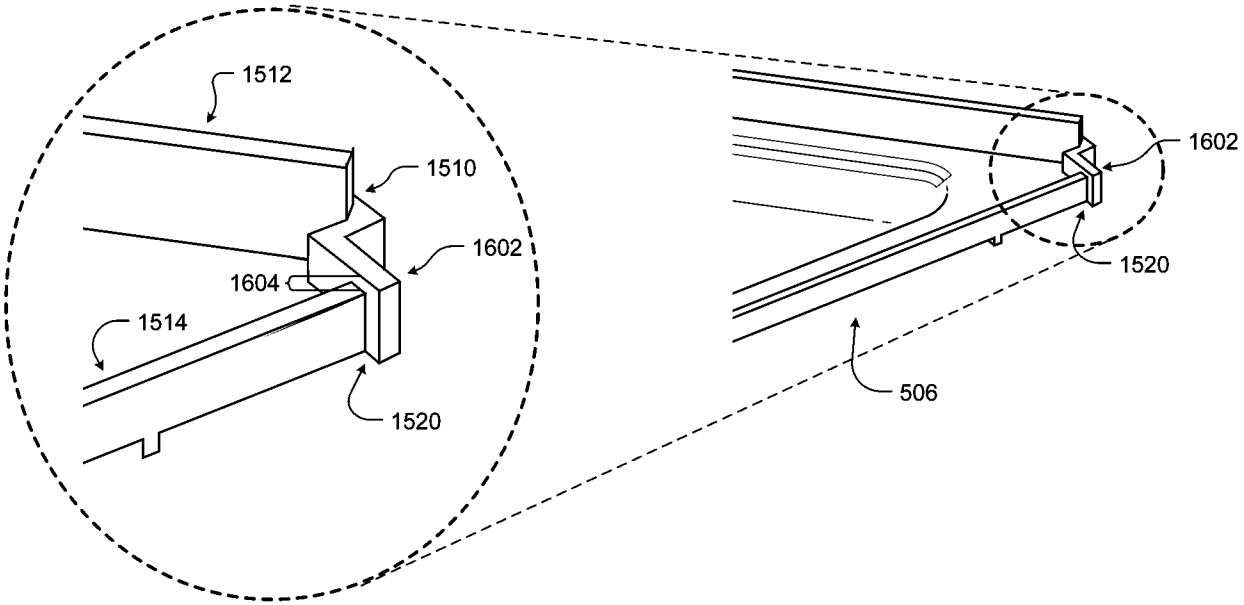
FIG. 16 illustrates an example exploded view of a portion of the spill tray of the beverage dispensing system according to some implementations.

FIG. 16 illustrates an example exploded view of a portion of the spill tray 506 of the beverage dispensing system 100 according to some implementations. As discussed above, the cover (not shown) is configured to be placed over the spill tray 506 during use and a capillary action disruption space 1520 is formed between the front face of the cover and the front portion 1514 of the flashing 1510. In some cases, the capillary action disruption space 1520 between the front face of the cover and the front portion 1514 of the flashing 1510 may be between approximately 0.8 inches and 1.9 inches. In one specific implementation, the capillary action disruption space 1520 may be approximately 1.18 inches.

In the currently illustrated example, the flashing 1510 also includes a third portion 1602 located between the back portion 1512 and the front portion 1514. The third portion 1602 may have a height that is less than the height of the back portion 1512 but greater than the height of the front portion 1514. In some examples, a top surface of the third portion 1602 may be in contact with the cover when in place over the spill tray 506, while a top surface of the front portion 1514 of the flashing 1510 is separated from the cover by a second capillary action disruption space, generally indicated by 1604.

Figure 17:
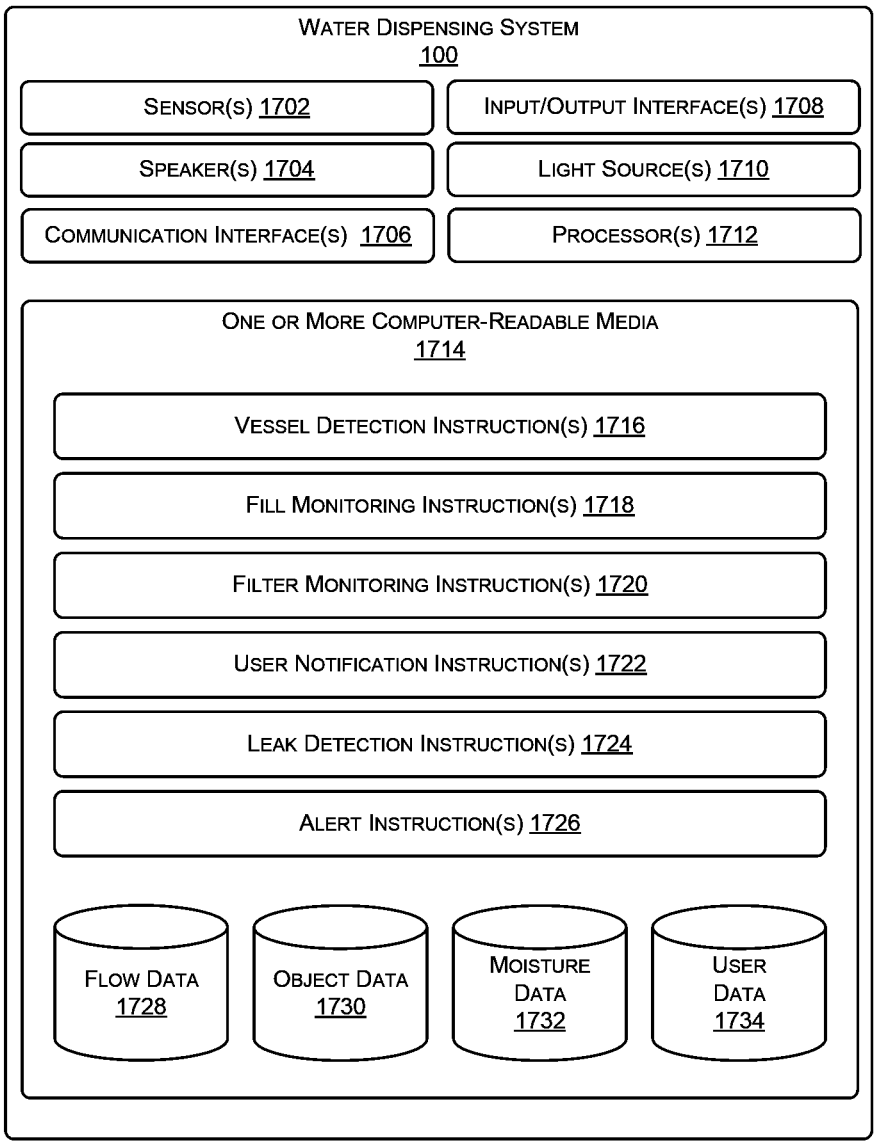
FIG. 17 illustrates an example block diagram of example components of the beverage dispensing system according to some implementations.

FIG. 17 illustrates an example block diagram of example components of the beverage dispensing system 100 according to some implementations. As described above, the beverage dispensing system 100 may include electrical components configured to monitor and control an amount and rate of liquid (such as water) dispensed by the system 100. For example, the system 100 may include sensors 1702, speakers 1704, communication interfaces 1706, input/output interfaces 1708, light sources 1710, processors 1712, and/or computer-readable media 1714.

The sensors 1702 may be configured to collect data associated with the system 100. For example, the sensors 1702 may include flow sensors associated with the drain feature and/or the beverage dispensing nozzle to collect flow data 1728 associated with liquid (such as water) flow into and out of the system 100. The sensors 1702 may include one or more object detection sensors, such as proximity sensors, to collect object data 1730 associated with the presence of a vessel within the alcove of the system 100. In some cases, the system 100 may also include moisture sensors at various positions around the spill tray and/or wall of the alcove to collect moisture data 1732 associated with any potential leaks or overflow events.

The speakers 1704 may be configured to output audio data as sound. For examples, the speakers 17042 may include one or more speakers such as an array of speakers. In some cases, the speakers 1704 may be arranges to reproduce directionality of sound. For example, the system 100 may cause the speakers 1704 to output audio in relation to a fill level of a vessel placed within the alcove of the system 100.

The communication interfaces 1706 may be configured to facilitate communication between one or more networks, one or more cloud-based systems and/or one or more devices (such as a mobile electronic device). The communication interfaces 1706 may also facilitate communication between one or more wireless access points, a master device, and/or one or more other computing devices as part of an ad-hoc or home network system. The communication interfaces 1706 may support both wired and wireless connection to various networks, such as cellular networks, radio, WiFi networks, short-range or near-field networks (e.g., Bluetooth®), infrared signals, local area networks, wide area networks, the Internet®, and so forth.

The input/output devices 1708 may be an input device, such as actuatable buttons, dials, or the like or touch enabled component or sensor (e.g., capacitive touch sensor or resistive touch sensor, etc.). The input/output devices 1708 may also include one or more display for providing visual feedback to the user. The input/output devices 1708 may also include one or more tactile outputs, such as haptic feedback units for providing a physical feedback to the user, such as vibrating to provide a fill level warning to a user. In some cases, the input/output devices 1708 may be combined into a single device, such as a touch enabled display. In some cases, the input/output devices 1708 may be used by the user to manually control the amount of liquid (such as water) dispensed into the vessel, set temperature of the liquid (such as water), set flow rates, adjust parameters associated with an auto-fill, or otherwise provide input.

The processors 1712, such as at least one or more access components, control logic circuits, central processing units, or processors, as well as one or more computer-readable media 1714 to perform functions. Additionally, each of the processors 1712 may itself comprise one or more processors or processing cores.

Depending on the configuration, the computer-readable media 1714 may be an example of tangible non-transitory computer storage media and may include volatile and non-volatile memory and/or removable and non-removable media implemented in any type of technology for storage of information such as computer-readable instructions or modules, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processors 1712.

Several modules such as instructions, data stores, and so forth may be stored within the computer-readable media 1714 and configured to execute on the processors 1712. For example, as illustrated, the computer-readable media 1714 store component vessel detection instructions 1716, fill monitoring instructions 1718, filter monitoring instructions 1720, user notification instructions 1722, leak detection instruction(s) 1724, alert instruction(s) 1726 as well as other instructions. The computer-readable media 1714 may also store data, such as flow data 1728, object data 1730, moisture data 1732, and user data 1734 (e.g., user settings and user preferences).

The vessel detection instructions 1716 may be configured to receive the object data from the sensors 1702 and to determine if a vessel is present and correctly positioned within the alcove. In some cases, the vessel detection instructions 1716 may cause the system 100 to commence dispensing of liquid (such as water) into the detected vessel and to cause the system 100 to terminate the dispensing of liquid (such as water) when the vessel is removed.

The fill monitoring instructions 1718 may be configured to receive the flow data 1728 from the sensors 1702 and to use the flow data 1728 to control various user indicators, such as the lighting sources 1710 or the speakers 1704. For instance, the fill monitoring instructions 1718 may cause an intensity of the lighting sources 1710 to increase or decrease as the vessel is filled and/or cause the volume of the sound output by the speakers 1704 to increase or decrease as the vessel is filled.

The filter monitoring instructions 1720 may be configured to monitor a health or lifetime of a filter coupled to the system 100. For example, the filter monitoring instructions 1720 may monitor the lifetime of a filter based on the flow data 1728. In other cases, the filter monitoring instructions 1720 may confirm the filter is new and authorized based on data collected by the filter when coupled to the system 100 to prevent damage to the system 100 by use of old or incompatible filters.

The user notification instructions 1722 may cause the communication interfaces 1706 to send data and/or messages to a device associated with the system 100. For example, the user notification instructions 1722 may send a message to the user's device indicating that the filter should be replaced. In another example, the user notification instructions 1722 may cause the communication interfaces 1706 to send a message to the user's device indicating an environmental impact of the system 100, such as a number of plastic bottles saved by use of the system 100.

The leak detection instructions 1724 may analyze the moisture data 1732 and determine if the system 100 is leaking liquid (such as water) into the walls of the structure. In other cases, the leak detection instruction 1724 may analyze the moisture data 1732 to detect overflow events and cause the system 100 to activate a shutoff valve in response.

The alert instructions 1726 may cause the communication interfaces 1706 to send an alert to the user device in the response to the leak detection instruction 1724 detecting an overflow event. in addition to or in lieu of sending the alert, the alert instructions 1726 may cause the lighting sources 1710 to flash or the speakers 1704 to output warning sounds in response to the leak detection instruction 1724 detecting an overflow event.

The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as") provided herein, is intended merely to better illuminate the invention and does not pose a limitation on the scope of the invention unless otherwise claimed.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A wall-mounted liquid dispensing system comprising:

an alcove for receiving a vessel and defined by a top member, a back wall member and a bottom member, the alcove having a depth of less than or equal to 9.0 centimeters, a width of less than or equal to 37 centimeters, and comprising:

a liquid dispensing nozzle, the liquid dispensing nozzle positioned along the top member;

a first sensor to generate vessel data usable to determine a presence of the vessel within the alcove and, in response to detecting the presence of the vessel within the alcove, cause the liquid dispensing nozzle to dispense liquid;

a drain feature;

a spill tray defining a raised area;

flashing extending upward from the raised area, the flashing including a front portion having a first height above the raised area and a back portion having a second height above the raised area, the second height greater than the first height;

a basin mechanically coupled to the drain feature;

a wall-mounted filter unit positioned below the alcove, the wall-mounted filter unit including:

a filter port for releasably coupling to a filter;

a slidable door configured to open to expose the filter; and a supply line coupled to a liquid supply, the filter, and the liquid dispensing nozzle during use.

2. The wall-mounted liquid dispensing system as recited in claim 1, wherein the alcove has a middle area that has:

a depth of less than or equal to 11 centimeters and a width that is less than or equal to 14 centimeters;

a right area that has a depth that transitions from the depth of the middle area to a position flush with a front surface of the wall-mounted dispenser; and a left area that has a depth that transitions from the depth of the middle area to the position flush with the front surface of the wall-mounted dispenser.

3. The wall-mounted liquid dispensing system as recited in claim 1, further comprising a wall-mounted compartment below the wall-mounted filter unit.

4. The wall-mounted liquid dispensing system as recited in claim 1, further comprising:

a first visual indication;

a communication interface; and wherein the first visual indication to activates and the communication interface generates an alert to a user device in response to the filter processing a predetermine amount of liquid or a predetermine amount of time elapsing.

5. The wall-mounted liquid dispensing system as recited in claim 1, wherein the flashing also includes an intermediate portion having a third height greater than the first height and less than the second height.

6. The wall-mounted liquid dispensing system as recited in claim 1, wherein:

the spill tray includes a back wall mating member extending upwards from the raised area; and the back wall mating member and the back portion of the flashing are positioned on either side of the back wall member of the alcove.

7. The wall-mounted liquid dispensing system as recited in claim 1, further comprising:

a second sensor associated with the liquid dispensing nozzle and configured to generate dispensing data associated with an amount of liquid dispensed by the liquid dispensing nozzle; and a third sensor positioned along a front surface of the spill tray to generate moisture data usable to detect an overflow event.

8. The wall-mounted liquid dispensing system as recited in claim 7, further comprising:

one or more processors;

a communication interface a computer-readable storage media, storing instructions which when executed by the one or more processors, cause the one or more processors to perform operation comprising:

receiving the moisture data from the third sensor;

determining from the moisture data that a leak event has occurred; and causing, in response to determining the leak event has occurred, the communication interface to send a leak alert to a user device associated with the wall-mounted liquid dispensing system.

9. The wall-mounted liquid dispensing system as recited in claim 8, wherein the operation further comprise causing, in response to determining the leak event has occurred, a shutoff value to activate to close the liquid dispensing nozzle.

10. The wall-mounted liquid dispensing system as recited in claim 8, wherein the operation further comprise causing the liquid dispensing nozzle to slow a rate of flow based at least in part on the dispensing data, the vessel data, and one or more predetermined threshold amounts.

11. The wall-mounted liquid dispensing system as recited in claim 8, further comprising at least one speaker to output sound associated with the liquid dispensing nozzle dispensing liquid and wherein the operation further comprise setting a volume level of the sound output by the at least one speaker based at least in part on the dispensing data.

12. A wall-mounted liquid dispensing system comprising:

a dispenser unit having a depth of less than or equal to 9.0 centimeters and a width of less than or equal to 37 centimeters, the dispenser unit defining an alcove defined by a top member, a back wall member, and a bottom member;

a liquid dispensing nozzle with at least one solenoid coupled to a supply line, the liquid dispensing nozzle positioned along the top member of the dispenser unit and extending into the alcove;

a drain;

a spill tray defining a raised area, flashing extending upward from the raised area, and a basin, the basin mechanically coupled to the drain; and a filter unit positioned adjacent to the dispenser unit, the filter unit in liquid communication with the at least one solenoid, the filter unit including a filter box for receiving a filter, a filter port for releasably coupling to the filter, and the filter unit having a depth that is equal to or less than 9.0 centimeters and a width that is less than or equal to 37 centimeters, the filter unit configured to open to expose the filter box;

a first sensor positioned along the back wall member of the alcove, the first sensor to generate vessel data associated with a vessel within the dispenser unit;

a second sensor associated with the at least one solenoid and configured to generate dispensing data associated with an amount of liquid dispensed by the at least one solenoid; and a third sensor positioned along a front surface of the spill tray to generate moisture data usable to detect an overflow event;

one or more processors;

one more communication interfaces; and a computer-readable storage media, storing instructions which when executed by the one or more processors, cause the one or more processors to perform operation comprising:

receiving vessel data from the first sensor;

detecting based at least in part on the vessel data a presence of the vessel within the alcove;

in response to detecting the presence of the vessel, causing the at least one solenoid to dispense liquid into the vessel;

receiving dispensing data from the second sensor;

determining based at least in part on the dispensing data and amount of liquid dispensed;

causing the one or more communication interface to send a notification to a user device associated with the wall-mounted liquid dispensing system, the notification including the amount of liquid dispensed;

receiving moisture data from the third sensor;

determining from the moisture data that a leak event has occurred; and causing, in response to determining the leak event has occurred, the communication interface to send a leak alert to the user device.

13. The wall-mounted liquid dispensing system as recited in claim 12, wherein the operation further comprise determining based at least in part on the vessel data a position of the vessel with respect to the at least one solenoid prior to causing the at least one solenoid to dispense liquid into the vessel.

14. The wall-mounted liquid dispensing system as recited in claim 12, wherein the operation further comprise causing the at least one solenoid to slow a rate of flow based at least in part on the dispensing data.

15. The wall-mounted liquid dispensing system as recited in claim 14, wherein the rate of flow is slowed by reducing a size of an opening of the at least one solenoid based at least in part on the vessel data.

16. The wall-mounted liquid dispensing system as recited in claim 14, wherein the rate of flow is slowed based at least in part on one or more predetermined threshold amounts.

17. A wall-mounted liquid dispensing system comprising:

an alcove exposed to a user and partially defined by a first in-wall portion and partially defined by a first front portion, the first in-wall portion having a depth of less than or equal to 9.0 centimeters and a width of less than or equal to 37 centimeters, and the first front portion couple to the first in-wall portion, the first front portion having a depth of less than or equal to 3.0 centimeters and a width of less than or equal to 45 centimeters;

a liquid dispensing nozzle with at least one solenoid, the liquid dispensing nozzle extending downward into the alcove; and a spill tray defining a raised area, flashing extending upward from the raised area, and a basin;

a wall-mounted filter unit partially defined by a second in-wall portion and partially defined by a second front portion, the wall-mounted filter unit positioned adjacent to the alcove, the second in-wall portion in liquid communication with the first in-wall portion, the second in-wall portion having a depth of less than or equal to 9.0 centimeters and a width of less than or equal to 37 centimeters, the second in-wall portion housed within the wall when installed and defining a filter box, the filter box having a length of less than or equal to 32 centimeters, a depth of less than or equal to 5.0 centimeters, and a height less than or equal to 16 centimeters, and the second front portion coupled to the second in-wall portion, the second front portion having a depth of less than or equal to 3.0 centimeters and a width of less than or equal to 45 centimeters;

a first sensor positioned along the alcove, the first sensor to generate vessel data associated with a vessel within the alcove;

a second sensor associated with the at least one solenoid and configured to generate dispensing data associated with an amount of liquid dispensed by the at least one solenoid; and one or more processors;

one more communication interfaces; and a computer-readable storage media, storing instructions which when executed by the one or more processors, cause the one or more processors to perform operation comprising:

receiving vessel data from the first sensor;

detecting based at least in part on the vessel data a presence of the vessel within the alcove;

in response to detecting the presence of the vessel, causing the at least one solenoid to dispense liquid into the vessel;

receiving dispensing data from the second sensor;

determining based at least in part on the dispensing data and amount of liquid dispensed; and causing the one or more communication interface to send a notification to a user device associated with the wall-mounted liquid dispensing system, the notification including the amount of liquid dispensed.

18. The wall-mounted liquid dispensing system as recited in claim 17, further comprising a third sensor positioned along a front surface of the spill tray to generate moisture data usable to detect an overflow event and wherein the operation further comprise:

receiving moisture data from the third sensor;

determining from the moisture data that a leak event has occurred; and causing, in response to determining the leak event has occurred, the communication interface to send a leak alert to the user device.

19. The wall-mounted liquid dispensing system as recited in claim 17, wherein the operation further comprise causing the at least one solenoid to slow a rate of flow based at least in part on the dispensing data, the vessel data, and one or more predetermined threshold amounts.

20. The wall-mounted liquid dispensing system as recited in claim 19, wherein the one or more predetermined threshold amounts are user defined.

* * * * *